US005119060A

United States Patent [19]

Bzdak et al.

[11] Patent Number: 5,119,060

[45] Date of Patent: Jun. 2, 1992

[54] DROPOUT EXPULSION FUSE

[75] Inventors: Richard J. Bzdak, Allegany; Stephen Johnson, Olean, both of N.Y.; Stephen Hassler, Muskego, Wis.

[73] Assignee: Cooper Power Systems, Inc., Coraopolis, Pa.

[21] Appl. No.: 645,076

[22] Filed: Jan. 23, 1991

[51] Int. Cl.[5] ..... H01H 85/143; H01H 71/20; H01H 85/02

[52] U.S. Cl. ..... 337/249; 337/217; 337/251

[58] Field of Search ..... 337/247, 248, 249, 251, 337/252, 253, 203, 217, 218, 219, 180, 181

[56] References Cited

U.S. PATENT DOCUMENTS 2,253,719 8/1941 McMahon ..... 337/249
3,735,315 5/1973 Swarbrick ..... 337/290
4,121,187 10/1978 Mahieu ..... 337/171
4,161,714 7/1979 Jacobs, Jr. ..... 337/251
4,272,751 6/1981 Biller et al. ..... 337/231
4,349,803 9/1982 Tobin ..... 337/247

*Primary Examiner*—Harold Broome
*Attorney, Agent, or Firm*—Elliott Cox; David A. Rose; Donald J. Verplancken

[57] ABSTRACT

An expulsion type fuse is provided which is resistant to line surges caused by lightning. The fuse includes an inner fusing assembly which has a tube and a knurled conductive button inserted in one end of the tube. A fusing area is provided wherein a pair of fusing leads are disposed into a cylindrical solder pot. One of such pairs interconnects the button to the solder pot. The other pair interconnects the fuse leader to the solder pot.

12 Claims, 3 Drawing Sheets

DROPOUT EXPULSION FUSE

BACKGROUND OF THE INVENTION

This invention relates to the field of power transmission and distribution equipment, more particularly to the field of protective devices for power transmission and distribution equipment, and more particularly still to the field of localized protection of power transmission and distribution equipment, such as transformers and surge arrestors.

Transformers placed on poles, or at remote distribution sites, are subject to the ravages of weather with little to protect them. When storms create high winds, adjacent wires between poles can touch, which creates a surge in the line which can cause a short in the transformer. Likewise, if lightning hits a wire or the transformer, a violent transformer destroying electrical surge will pass through an unprotected transformer. To help prevent these disruptive weather related occurrences from destroying the distribution equipment, surge arrestors and fuses are placed in the distribution network immediately adjacent the transformer, or other component, which is to be protected.

Fuses are used to protect the transformers located on poles or at remote locations in the distribution network. Power lines coming into the transformer are typically rated at between one half and 100 amps, having voltages of between 2400 and 38000 volts. These fuses are commonly placed in a parallel electrical relation to the surge arrestor. The fuse, and transformer, are mounted in series. These two components in series are then mounted in an electrically parallel configuration to the surge arrestor. The arrestor provides protection to the transformer by diverting surges, such as those caused by lightning, to ground, rather than through the fuse and transformer and into the rest of the distribution network. When a large amperage surge occurs, such as that caused by a lightning strike on the distribution power line, the surge arrestor will change its impedance to create a very low resistance path to ground. The surge will thus pass primarily through the surge arrestor, which has a substantially lower impedance and resistance than the fuse and transformer combination. The fuse provides long term overload protection to the circuit, such as what occurs when a short appears as a result of a failure in the transformer or a long term over load situation is present in the secondary circuit. However, the fuse is not intended to carry the lightning surge to ground. The prior art fuses cannot withstand the full surge current created during a lightning strike, and thus the surge arrestor must be placed in parallel with the series combination of the transformer and fuse to protect both the transformer and the fuse.

To physically locate the surge arrestor and fuse-transformer combination in a parallel electrical configuration, the surge arrestor and fuse are both placed upon the pole, or otherwise remotely located from the transformer tank, and the ground lead is run from the transformer tank to the surge arrestor. This arrangement leads to less protection of the transformer secondary windings than would be present if the surge arrester were mounted directly on or in the transformer tank. It is known that the longer the length of the lead between the transformer and surge arrestor, the greater the likelihood of damage occurring to the secondary transformer windings during a current surge condition. However, the prior art fuses dictate that the surge arrestor be remotely mounted, in order that the surge arrestor and fuse may be mounted in parallel to protect the transformer and fuse.

The individual fuse associated with a transformer must be sized to protect the transformer, but not prematurely open in response to rated amperage or low overload conditions. Each transformer will have a specific rated primary amperage and voltage which must pass therethrough to provide the proper total voltage and amperage on the secondary, or low voltage, side thereof. Likewise, as the rated amperage and voltage of the transformer varies from application to application, the fuse which protects the transformer must be sized to match the performance rating of the transformer. Therefore, the fuse manufacturer typically must supply a line of fuses with different opening amperages for transformer protection. These requirements are well known in the art, and handbooks, design manuals and government and industry standards are promulgated which dictate to designers the power absorption, time to blow, and overcurrent characteristics of fuses for high energy applications.

SUMMARY OF THE INVENTION

The present invention is an improved surge durable dropout expulsion fuse used to protect transformers in a distribution network. The invention includes a precision crafted moisture resistant housing for protecting the fuse circuit, a knurled barbed conductive button press fitted into one end of the tube, a leader wire disposed out the other end of the tube, and a solder pot interconnecting the button and lead to provide an interruption means for opening the circuit during long term overload conditions, all mounted within a dropout expulsion housing. The solder pot is a cylindrical annular segment, into which a plurality of wire elements are directed from the button and from the lead. The elements are manufactured to a close tolerance, such that the total cross sectional area of the elements on each side of the solder pot is a specified value for each class of element base material.

The improved link may be used as a fuse in series with the surge arrestor to protect the transformer from overload and surge conditions. In this configuration, the high voltage line into the transformer is protected by the fuse, and this fuse protected line splits into parallel conductive circuits leading to the surge arrestor and the transformer.

The use of elements having a specified minimum cross-sectional area permits the fuse to carry a lightning surge without failure, while at the same time being capable of precision opening in response to low circuit overload conditions. When a surge occurs due to a lightning strike, the fuse in most cases will carry the entire energy of the surge, and the surge will then pass through to the surge arrestor -transformer combination. At this point, the surge arrestor will create a very low impedance path therethrough to ground, thereby diverting most of the surge energy to ground and not through the transformer. This permits the surge arrestor to be mounted in or on the transformer to reduce or eliminate the lead length between these components. This lower lead length increases the effective ability of the surge arrestor to protect the primary coils of the transformer from overload surges.

These and other objects and advantages of the invention will become apparent from the following description and accompanying drawings.

BRIEF DESCRIPTION OF THE DRAWINGS

For a detailed description of the invention, reference will now be made to the following drawings, wherein.

BRIEF DESCRIPTION OF THE PREFERRED EMBODIMENT

Figure 1:
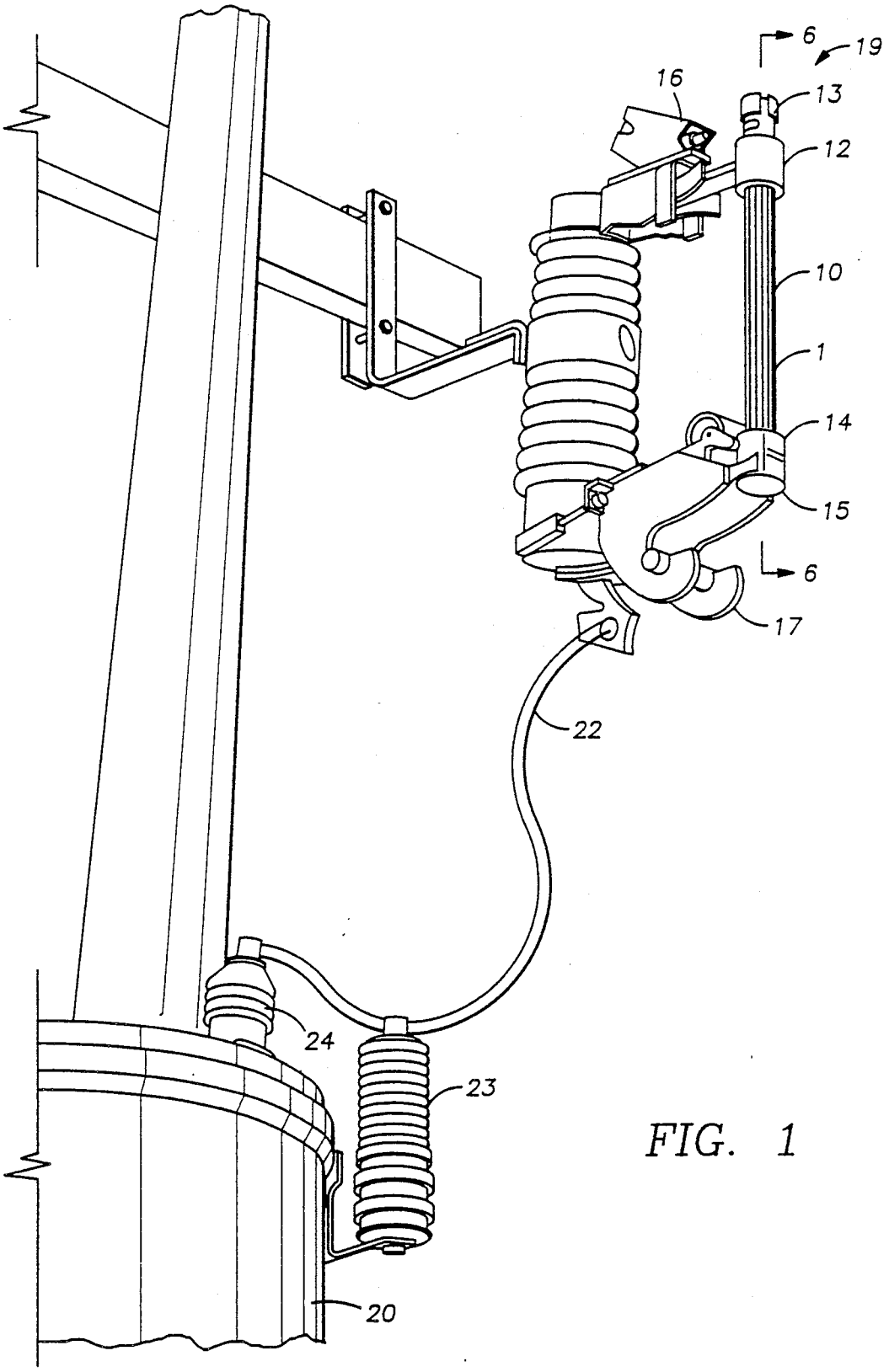
FIG. 1 is a perspective view of the fuse of the present invention mounted in a carrier.

Referring initially to FIG. 1, the fuse 1 of the present invention is housed in a dropout expulsion housing 10 having a protective outer tube 11 with a lower open end 15 and an upper closed end 19 with a conductive end ferrule 13 mounted thereon. Dropout expulsion housing 10 is retained in fixture 16 having an upper retainer 12 and a lower trunnion 14. The upper end 19 of outer tube 11 is mounted in retainer 12 and the lower end 15 of dropout expulsion housing 10 is mounted in trunnion 14. Fixture 16 may be mounted to a pole 18, or to a housing or other structure to which a transformer 20 is located. Fuse assembly 9 (Shown in FIGS. 2 and 6) is held within dropout expulsion housing 10. Housing 10 is located adjacent the transformer 20 to protect transformer 20 from electrical overloads, as will be described further herein. A conductive line lead 22 extends from a high voltage bushing 24 disposed on transformer 20 to the lower trunnion 14 of fixture 16. A leader 32 connected to the fuse of the present invention extends through tube 10 to be ultimately electrically connected with trunnion 14. Likewise, a high voltage lead (not shown) extends from the high voltage service line to the retainer 12. Thus, power is supplied through fuse 1 from the line lead, which then passes through fuse 1 to transformer 20 and the surge arrestor 23. The surge arrestor 23 is housed in an electrical parallel relationship to the transformer windings, but in a series configuration with the fuse. The transformer 20 is likewise in series with the fuse. The surge arrestor 23 may also be mounted within the transformer tank to further reduce line losses and thereby enhance the protective capability of the surge arrestor.

Figure 2:
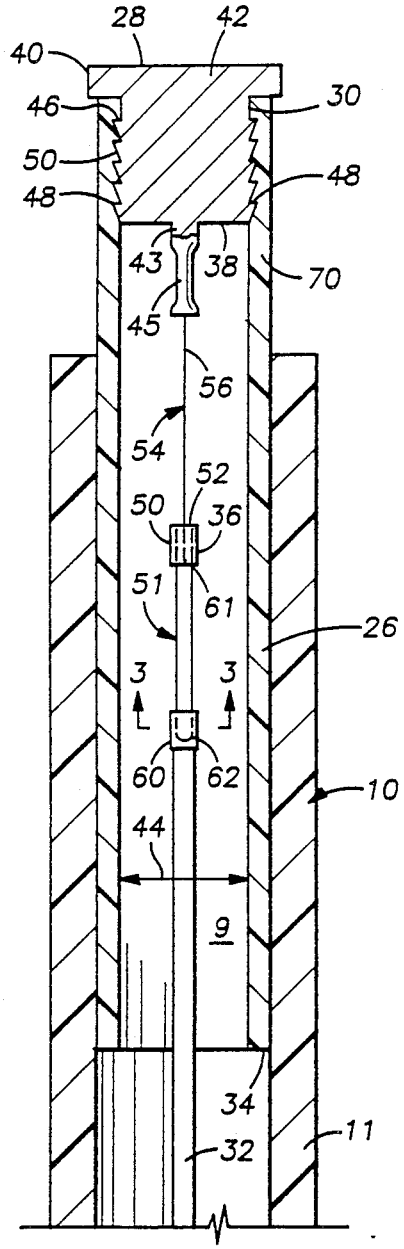
FIG. 2 is a partial sectional view of the fuse of FIG. 1.

Referring now to FIG. 2, fuse assembly 9 includes an inner protective tube 26 adapted to be disposed within outer protective tube 11 of dropout expulsion housing 10, a button 28 closing one end of tube 26, a lead wire 32 extending out of the other open end of tubes 11, 26, and a fusing link 36 having one end electrically connected to button 28 and its other end electrically connected to lead wire 32. Fusing link 36 is structured and arranged to permit normal and short term surge currents to pass therethrough without failure, but will fail in response to a long term overload conditions and to transformer induced faults.

Outer protective tube 11 of dropout expulsion housing 10 is an electrically insulative tubular member having a diameter sized to receive inner protective tube 26. Outer tube 11 is longer than inner tube 26 as is hereinafter described with respect to FIG. 6.

Inner protective tube 26 is an electrically insulative tubular member having a tubular shell or wall 38 with an internal diameter 44 and opposed open ends 30, 34. The wall 38 of tube 26 is preferably manufactured by spirally winding several bilayers of fish and natural dielectric kraft paper which has previously been vacuum impregnated with an electrical grade resin for moisture protection. Wall 38 is sufficiently thick to withstand the internal eruption of the internal fuse components in the event of a catastrophic fuse interruption.

Button 28 is generally cylindrical with an enlarged head 40 having a diameter larger than the internal diameter 44 of inner tube 26, an anchoring shank 42 extending from head 40 with a diameter slightly larger than the internal diameter 44 of inner tube 26, and a tongue 43 extending inward from shank 42. Head 28 is preferably a single piece of conductive material such as steel, copper or brass, formed into a blank by a cold heading operation and then machined and knurled into its final configuration.

Figure 4:
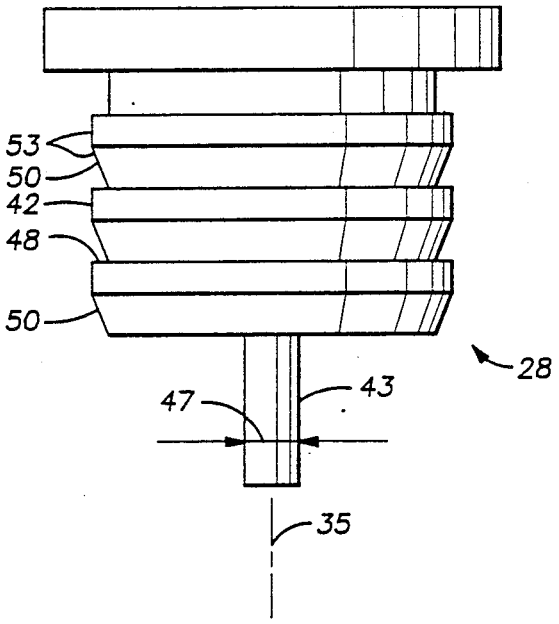
FIG. 4 is a side view of the button shown in the fuse in FIG. 2.

Referring now to FIG. 4, shank 42 includes a series of external barbs 46 which allow insertion of button 28 into end 30 of inner tube 26 but prevent extraction therefrom. Each barb 46 includes a normal face 48 projecting outward from shank 42 and substantially perpendicular thereto, an extended portion 53 extending along the outer surface of the shank 42 from the outer terminus of face 48, and a tapered portion 50 extending from the terminus of extended portion 53 and circumferentially and axially inward therefrom to the base of the next adjacent face 48. Extended portion 53 is a circumferential section or segment forming the outer circumference of shank 42. Barbs 46 preferably are formed by knurling shank 42 into a series of concentric circles, and then linearly knurling shank 42 parallel to the center line 35 of button 28 evenly about the circumference thereof. This operation will result in a series of individual barbs 46 on the outer circumference of shank 42, each barb bounded by the adjacent linear and circumferential knurls forming the next adjacent barbs, or the upper and lower ends of shank 42. Barbs 46 may be sized such that the lowest depression formed by the knurling operation is equal to the maximum inner diameter 44 of inner tube 26, so that barbs 46 will dig into the inner peripheral surface of inner tube 26 after button 28 is inserted therein. Thus, each barb 46 forms a one way lock which allows the button 28 to be inserted into wall 38 when the button is pressed into inner tube 26, but digs into the inner peripheral surface of wall 38 of inner tube 26 as button 38 is actuated outward from tube 26. By knurling individual barbs 46 into the button 28 as opposed to simply forming circular retaining ridges on the outer circumference thereof, button 28 will more easily enter inner tube 26 with lesser incidence of splitting or cracking of the tube 26, while at the same time forming a greater resistance to removal therefrom. Barbs 26 may also be formed without the extended portion 53 as shown in FIG. 2, and the knurling may be altered from the linear and circumferential knurling to tangential or other knurling patterns.

Figure 6:
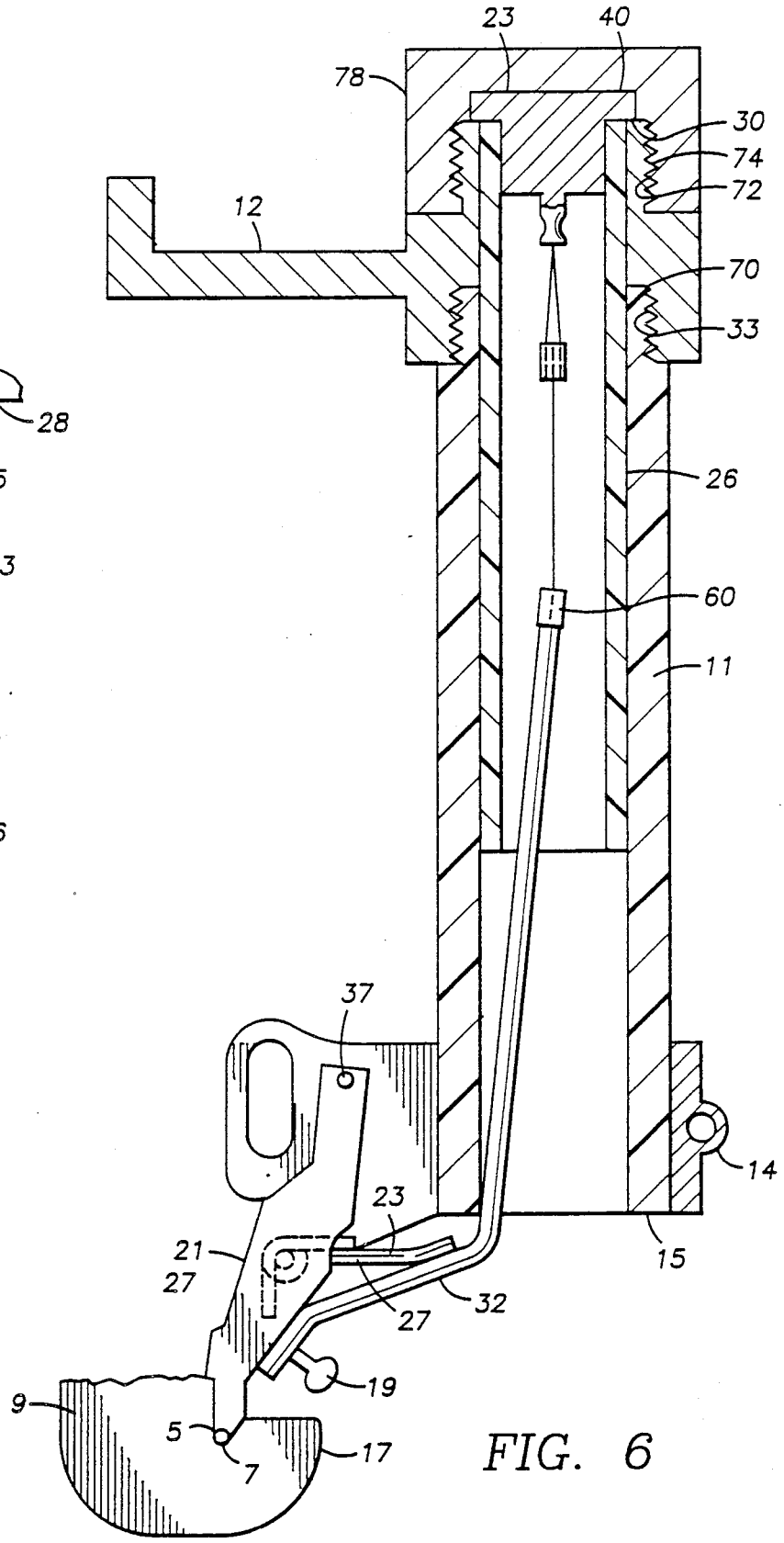
FIG. 6 is a sectional view of the fuse of FIG. 1 at section 6—6 having an alternative button configuration.

Referring to FIGS. 4 and 6, tongue 43 is a reduced diameter extension of shank 42 extending opposite from head 40. Tongue 43 is constructed of an electrically conductive material such as steel, copper or brass, and is preferably manufactured as an integral part of button 28, but may be manufactured separately and press fit, soldered, screwed or otherwise secured into a hole in the inner face of button 28. Tongue 43 is preferably a tubular member, having an internal diameter 47 which is slightly larger than the width of two fusing leads, as will be discussed further herein. Tongue 43 may also be a solid member with a slot 45 therethrough as shown in FIG. 2, or of another configuration which is capable of being interfaced and attached to fusing link 36. For example, the tongue may be manufactured as a solid tubular member, and the fusing wire 36 may be wrapped and soldered to the outer surface thereof.

Figure 3:
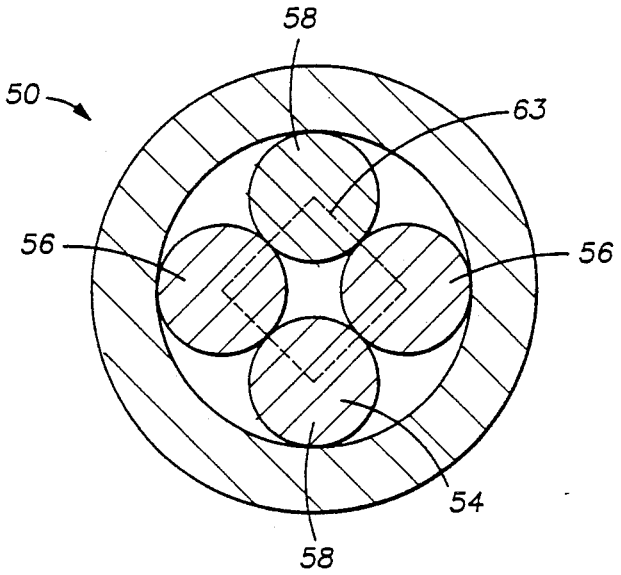
FIG. 3 is a sectional view of the fuse of FIG. 2 at section 3—3.
Figure 5:
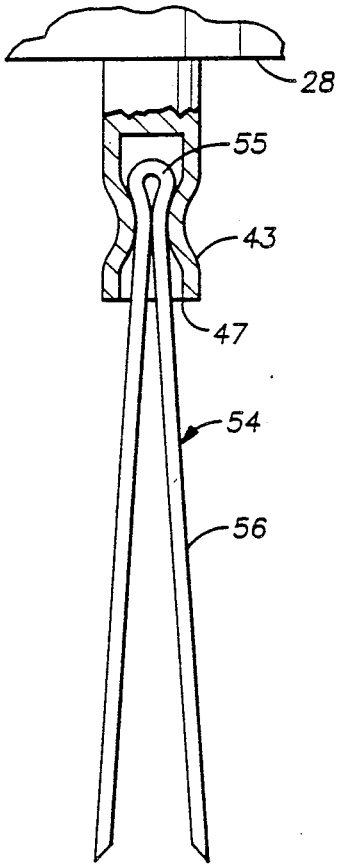
FIG. 5 is a side view of a portion of the fusing wire mounted in the button shown in FIG. 1, with the button shown in partial section.

Referring now to FIGS. 2, 3 and 5, fusing link 36 of fuse assembly 9 includes a first fusing wire 54, a complex solder pot 50, and a second fusing wire 51. Solder pot 50 is a cylindrical tubular pot for connecting first fusing wire 54 with second fusing wire 51. Wires 54, 51 are preferably a single thread of nickel chromium wire, 80% nickel and 20% chromium, which is folded in half. Wire 54 is folded in half, forming loop 55 and end portions 56. Wire 51 is folded in half forming loop 62 and end portions 58. Wire end portions 58 and 56 terminate within solder pot 50 where they are nested within the circumferential inner surface of pot 50. The perimeter 63, formed by interconnecting the centers of each wire end 56, 58 with an imaginary line, forms the shape of a square. Each end 56 or 58 of the same wire 51 or 54 is disposed at the opposite corner of the square, such that the wire ends 56, 58 are staggered within the perimeter of the pot 50. This configuration ensures maximum heat dissipation of the wire ends 56, 58 within pot 50 to ensure even heating thereof. Loop 55 of wire 54 is retained within tongue 43 of button 28, preferably by crimping loop 55 within the tubular inner diameter 47 thereof. As tubular inner diameter 47 is slightly larger than twice the width of wire 54, the folded over portion or loop 55 is slightly smaller than inner diameter 47 and therefore when the tubular portion is pressed to crimp, the loop 55 is readily secured therein. Loop 62 is likewise crimped into ferrule 60. It has been found that if the total cross-sectional area of the multiple nickel chromium fusing wire ends 56, 58 extending into solder pot 50 from the adjacent tongue 43 or ferrule 60 is at least 0.00098 square inches, i.e., the combined cross section of the two parallel wire end portions 56 or 58 is at least .00098 inches, a fuse assembly 9 of the present invention having a rated amperage from 0.5 amps to 20 amps for high voltage transformer protection service will withstand normal lightning created surges without failure. By folding a single wire in half to obtain the total minimum cross section from the two resulting ends, a close match of cross section of the two parallel conductive paths is ensured, thereby eliminating possible overloading of a single wire of the pair. Although use of two wires has been described, multiple wires may be employed without deviating from the scope of the invention, if the cross-sectional area remains the same as would occur with a single folded wire. Further, other materials, such a stainless steel, may be used by compensating for the changes in materials when computing the thickness of the wires. Likewise, the total cross-sectional area of the wires must also be adjusted to compensate for different amperage ratings of the fuse assembly 9.

To determine the minimum cross-sectional area for wires made of other materials, the intended $i^2t$ of the fuse link 36 is determined for the specific amperage and voltage rating of the fuse, and then the energy rating is determined from the resistivity, impedance and vaporizing characteristics of the material. This information is found in standard design handbooks. From this information, the total cross-sectional area of the wire is determined which is sufficient to supply the necessary $i^2t$ capacity for the rated amperage and fusing characteristics such as opening time. These calculations are well within the ability of one skilled in the art of fuse design. Likewise, the fusing wires 51, 54 need not be folded over, but may constitute individual strands which are soldered, welded, or otherwise physically and electronically affixed between the pot 50 and tongue 43 and between the pot 50 and the ferrule 60 of lead wire 32. Additional wires should also be placed within the pot 50 in the staggered fashion provided with the single folded wire 56 or 58.

To hold wire ends 56, 58 in pot 50, the juncture of pot 50 and wires 54, 51 is secured in solder 61. By varying the solder 61 used, the melting temperature of the juncture may be varied. As the temperature in the pot 50 is a function of the amount of heat generated by an overcurrent condition in wire ends 56, 58, a lower temperature solder 61 will melt at lower temperatures and thereby at lower amperage ratings. However, the nickel chrome wires will withstand high, short duration, surge currents without failure, thereby permitting the fuse to withstand lightning surges in the power distribution network.

It has been found that the staggering of the wires provides uniform heating of pot 50, thereby permitting the use of low melting point solders 61 in pot 50 to create low amperage fuses. Further, by splitting the total cross-sectional area of the wires into two or more wires, the total area of adhesion or contact between the solder 61 and wire ends 56, 58 within pot 50 is increased, thereby increasing the resistance of the solder pot 50 and wire ends 56, 58 to movement or creep resulting from the pressure applied thereto from flipper 23. If the wire cross-sectional area was not split into two or more wires, the total area of adhesion will be substantially less, which may lead to premature opening of pot 50 in response to rated current loads.

Referring now to FIG. 6, fuse assembly 9 is shown mounted in dropout expulsion housing 10 supported on a pole. Retainer 12 holding dropout expulsion housing 10 includes an inner threaded recess 70 having an aperture 72 therethrough through which end 30 of inner tube 26 projects. Head portion 40 of button 28 is larger than aperture 72, and head portion 40 therefore is retained over aperture 72 and holds inner tube 26, fusing link 36 and leader 32 within outer tube 11. Outer tube 11 is threadingly retained within inner threaded recess 70. To ensure electrical contact, and to help retain button 28 and inner tube 26 within outer tube 11 during high energy interruptions, upper end of retainer 12 includes outer threaded stud 74 through which aperture 72 and tube 26 project. Conductive end ferrule 13 is threaded over stud 74 to retain button 28 in place and ensure electrical conductive engagement between retainer 12 and button 28.

Trunnion 14 includes a carrier 21 hinged thereto at 37 and also hinged to strap 17. Trunnion includes a slot (not shown), which terminates adjacent hinge 37 an extends downward therefrom. A pin 39 extends through carrier 21 at hinge 37 into the slot. Leader 32 extends outward from the open ends of tubes 11 and 26 of dropout expulsion housing 10 where it is electrically connected to carrier 21 with a thumbscrew 19. Carrier 21 includes a spring biased flipper 23 which is spring biased so as to tension leader 32 downwardly and outward of open end 15. Flipper 23 is a generally planar member, mounted over a stud 27 located on carrier 21. Carrier 21 is mounted on its lower end to carrier strap portion 9 of strap 17, which includes a hook portion 7 which receives a pin 5 extending through carrier 21. Hook portion 7 is comprised of a pair of fingers, with carrier supported therebetween on pin 5. A biasing spring 25, including a tension arm 27 extending therefrom, is mounted over stud 27 such that arm 27 engages flipper 23 to bias it in a downward direction. Flipper 23 is mounted on stud 27 such that flipper may arcuately move with respect to the stud 27, the stud 27 serving as a center point of such arcuate movement.

Leader 32 is normally retained within tube 26 and crimped or otherwise attached to ferrule 60, and therefore flipper 23 is held in the upper position shown in FIGS. 5 and 6. When a long-term low overload condition is encountered by fuse assembly 9, the fuse link 36 in tube 26 severs as wire end portions 56 or 58 pull out of pot 50, and the tension on lead 32 is relieved and flipper 23 moves down to force lead 32 out of the open end 15 thereby opening the circuit. When flipper 23 flips downward, the carrier 21 slides downward on pin 39 in the slot in trunnion 14. This motion slides carrier 12 below a spring clip (not shown) on a bracket on pole 18, thereby freeing the upper end of fuse 1 from the pole 18. The upper end of the fuse then kicks outward, while the lower end is retained in carrier strap 9 through pin 5. To initiate the opening of the fuse to open the circuit to the transformer 20 in response to a long-term low overload condition, solder in pot 50 melts when sufficient heat has been generated to raise the solder temperature to the melting point. At this point, flipper 23 pulls leader 32 outward open end 15, thus pulling ends 58 out of pot 50 or pull pot 50 off of ends 58 to open the circuit. As discussed above, when tension is relieved on the leader 32, the fuse 1 will kick out of the upper portion of the pole 18 to indicate a fuse open condition.

In response to a high energy fault, the wire ends 56 and 58 melt and vaporize. As a result of arcing which occurs when the wire ends 56, 58 vaporize, the solder in pot 50 melts and becomes gaseous. Likewise, water in the tube 26 becomes vaporous. The melting and vaporization of wire ends 56, 58 opens the circuit in response to a short circuit, thereby protecting the transformer. Again, the fuse 1 kicks out to indicate a fuse opening.

While a preferred embodiment of the invention has been shown and described, modifications thereof can be made by one skilled in the art without departing from the spirit of the invention.

We claim:

1. A high voltage fuse for cutout type expulsion fuse applications, comprising;

an insulative outer tube having a first open end and a second end enclosed by a conductive cap portion;

an insulative inner tube having first and second open ends disposed within said outer tube;

a button having a shank portion thereon disposed in said first end of said inner tube;

a lead disposed in said second end of said inner tube and projecting therefrom;

a fusing member disposed within said inner tube and having electrical and mechanical engagement within said button and said lead;

said button shank portion having a plurality of barbs thereon;

wherein said fusing member includes a pot having a plurality of fuse wires projecting therefrom, said wires being consecutively nested within an inner perimeter of said pot.

2. The fuse of claim 1, wherein said barbs are knurled into said shank portion.

3. The fuse of claim 1 wherein said inner tube has multiple layers of vacuum impregnated fish and craft paper.

4. The fuse of claim 1, wherein said fuse wires projecting from either side of said pot have a minimum total cross-sectional area of 0.00098 square inches where the fuse may be rated from 0.5 amps to twenty amps.

5. The fuse of claim 4, wherein said wires in said pot are under tension and said pot including solder adhered to said wires, such that upon a long term circuit overload condition, the solder in said pot will melt and said wires will pull outward from at least one end of said pot.

6. A high voltage fuse having first and second electric connection points for introduction into a circuit for selective interruption of the circuit, the improvement therein comprising;

a pot having a hollow interior portion;

a first plurality of fusing wires extending form the first electric connection point to said hollow portion of said pot;

a second plurality of fusing wires extending form the second electric connection point to said hollow portion of said pot;

said first and second plurality of wires nested within said pot.

7. The fuse of claim 6, wherein said pot includes solder adhered to said fusing wires.

8. The fuse of claim 6, wherein said plurality of wires are two wires.

9. The fuse of claim 6, wherein said wires are consecutively nested within said pot, such that each of said first wires is disposed adjacent two of said second wires.

10. The fuse of claim 6, wherein said first and second plurality of wires are disposed in tension, such that upon the occurrence of a long term electric overload in the circuit, said first plurality of wires and said second plurality of wires will separate to cause the fuse to open.

11. A fuse, comprising;

an elongate hollow member having at least one open end portion;

a fusing member disposed through said elongate member;

a ferrule having a circumferential portion thereon, said circumferential portion received and secured within said open end portion;

said circumferential portion including at least one barb thereon, said barb including a second circumferential portion located outward from said circumferential portion and being concentric therewith throughout the extent of its arc, a primary anchoring portion disposed generally normal to said second circumferential portion and projecting normal thereto to the circumferential portion to from a retaining wall, and a secondary tapered wall extending form said second circumferential portion opposite said primary anchoring portion to said circumferential portion at an acute angle thereto.

12. The fuse of claim 11, wherein said secondary tapered wall terminates at the intersection of said anchoring portion with said circumferential portion.

* * * * *